US006203650B1

(12) United States Patent
Miller

(10) Patent No.: US 6,203,650 B1
(45) Date of Patent: Mar. 20, 2001

(54) METHOD FOR MANUFACTURING AN AIRTIGHT CELL FOR ENCLOSING SWITCHING APPARATUS

(76) Inventor: Bearge D. Miller, Route 796 - Woodview Rd., Jennersville, PA (US) 19390

( * ) Notice: Subject to any disclaimer, the term of this patent is extended or adjusted under 35 U.S.C. 154(b) by 0 days.

(21) Appl. No.: 09/187,581

(22) Filed: Nov. 5, 1998

Related U.S. Application Data

(60) Provisional application No. 60/064,514, filed on Nov. 5, 1997.

(51) Int. Cl.[7] ..... B31B 1/72

(52) U.S. Cl. ..... 156/227; 156/297; 493/210; 493/243

(58) Field of Search ..... 383/84, 85, 88; 493/153, 152, 156, 193, 968, 408, 210, 243; 229/931, 108, 111, 112; 428/34.3, 35.2, 35.5, 76; 156/217, 297, 211, 227; 53/477

(56) References Cited

U.S. PATENT DOCUMENTS

| | | | | |
|---|---|---|---|---|
| 1,385,831 | * | 7/1921 | Hulbert | 383/88 |
| 1,950,104 | * | 3/1934 | Ewers | 229/101 |
| 3,722,782 | * | 3/1973 | Collie | 229/108 |
| 4,487,648 | * | 12/1984 | Miller | 156/227 |

* cited by examiner

*Primary Examiner*—Michael W. Ball
*Assistant Examiner*—Gladys Piazza
(74) *Attorney, Agent, or Firm*—Robert B. Famiglio, Esq.; Famiglio & Associates

(57) ABSTRACT

A method for making an airtight, flexible cell for enclosing electrical switching apparatus in the application of a door edge safety strips is disclosed. The illustrated technique describes a method which includes a series of steps which may be applied to raw sheet material used in producing the airtight cell which reduces the number of steps necessary to encase the switching apparatus within the airtight cell, simplifying the folding operations required to produce a seam to enclose the switching apparatus. The invention provides for use of two pieces of material to construct an end of the airtight cell, one piece being substantially rectangular and the second piece is comprised of five sides.

2 Claims, 3 Drawing Sheets

METHOD FOR MANUFACTURING AN AIRTIGHT CELL FOR ENCLOSING SWITCHING APPARATUS

This application claims the benefit of the filing date of the applicant's provisional application Ser. No. 60/064,514 filed on Nov. 5, 1997.

BACKGROUND OF THE INVENTION

Method for making an airtight, flexible cell for enclosing electrical switching apparatus in the application of a door edge safety strips is disclosed. The illustrated technique describes a method which includes a series of steps which may be applied to the raw sheet material used in producing the airtight cell which reduces the number of steps necessary to encase the switching apparatus within the airtight cell, simplifying the folding operations required to produce a seam to enclose the switching apparatus. The method provides for the use of three independent sheets of material which are ultimately fastened to each other as described using radio frequency heating apparatus to provide the fastening means of the material used to create the airtight cell. A method of manufacturing airtight cell in the prior art is shown in Miller, U.S. Pat. No. 4,487,648, in which is illustrated a technique for a series of steps which are applied to raw sheet material which reduced the number of folding operations required to produce a seam. It would be appreciated by review of such prior art that an improvement consists of the shape alteration of the sheet of material used to form the end of one side of the cell along its longitudinal axes. The improved shape reduces the number of steps necessary to fasten a seam by eliminating one step.

SUMMARY OF THE INVENTION

The object of the present invention is to provide a manufacturing method for an airtight cell which is utilized to encase a door edge safety switch mechanism. The disclosed invention reduces construction time, manufacturing costs and increases the integrity and reliability of the seals used to form the airtight cells of the invention. The disclosed invention utilizes three pre-sized piece of materials which utilizes radio frequency welding in the preferred embodiment. Two of the sheets of materials are used to construct suitable airtight, sealable ends at the opposing longitudinal end of the third piece of material used to form the generally rectangular shape of the final airtight cell sealed by said radio frequency means.

DETAILED DESCRIPTION OF THE INVENTION

Figure 1:
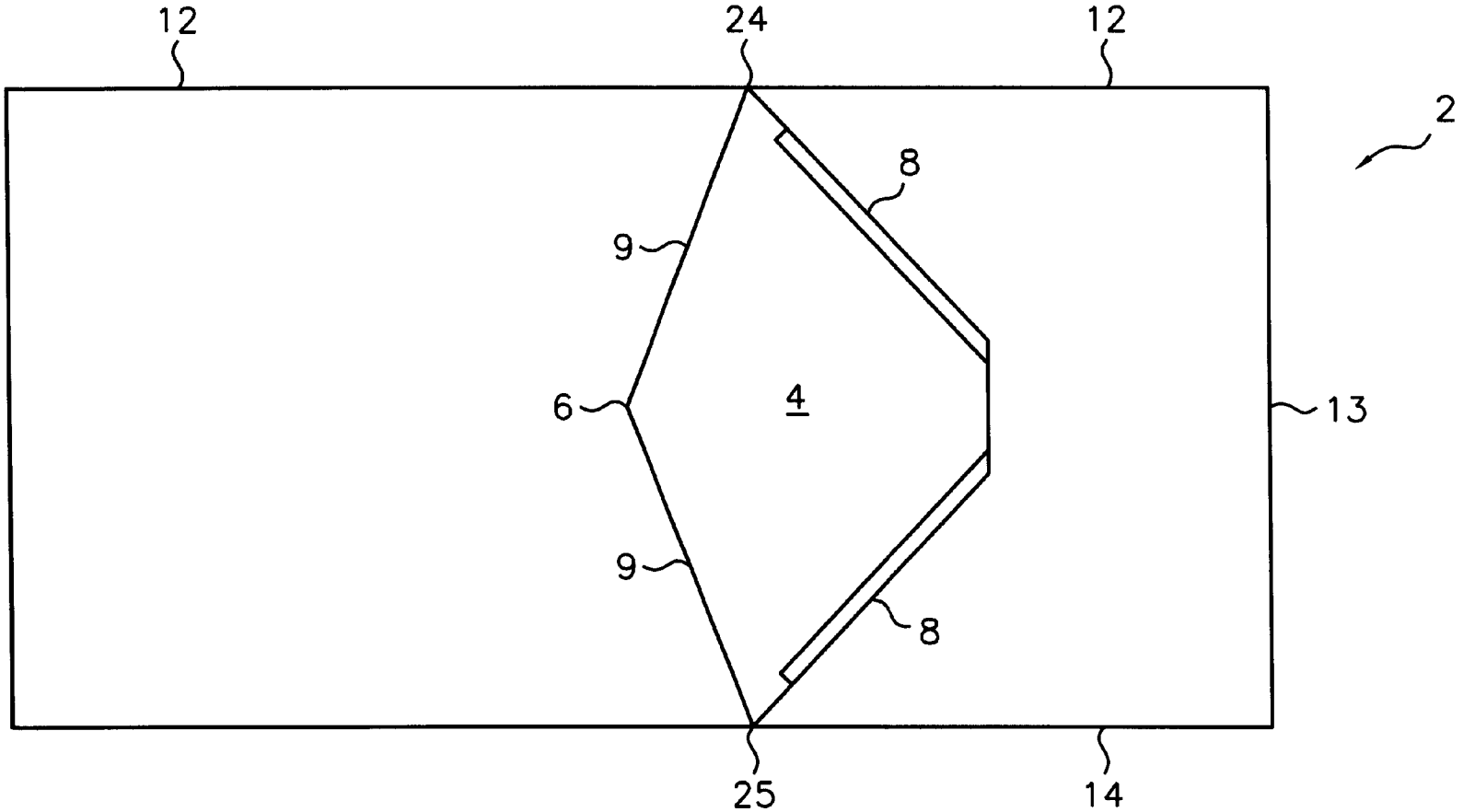
FIG. 1 the developmental view of the end section encasement of the present invention illustrating the method of manufacture.
Figure 2:
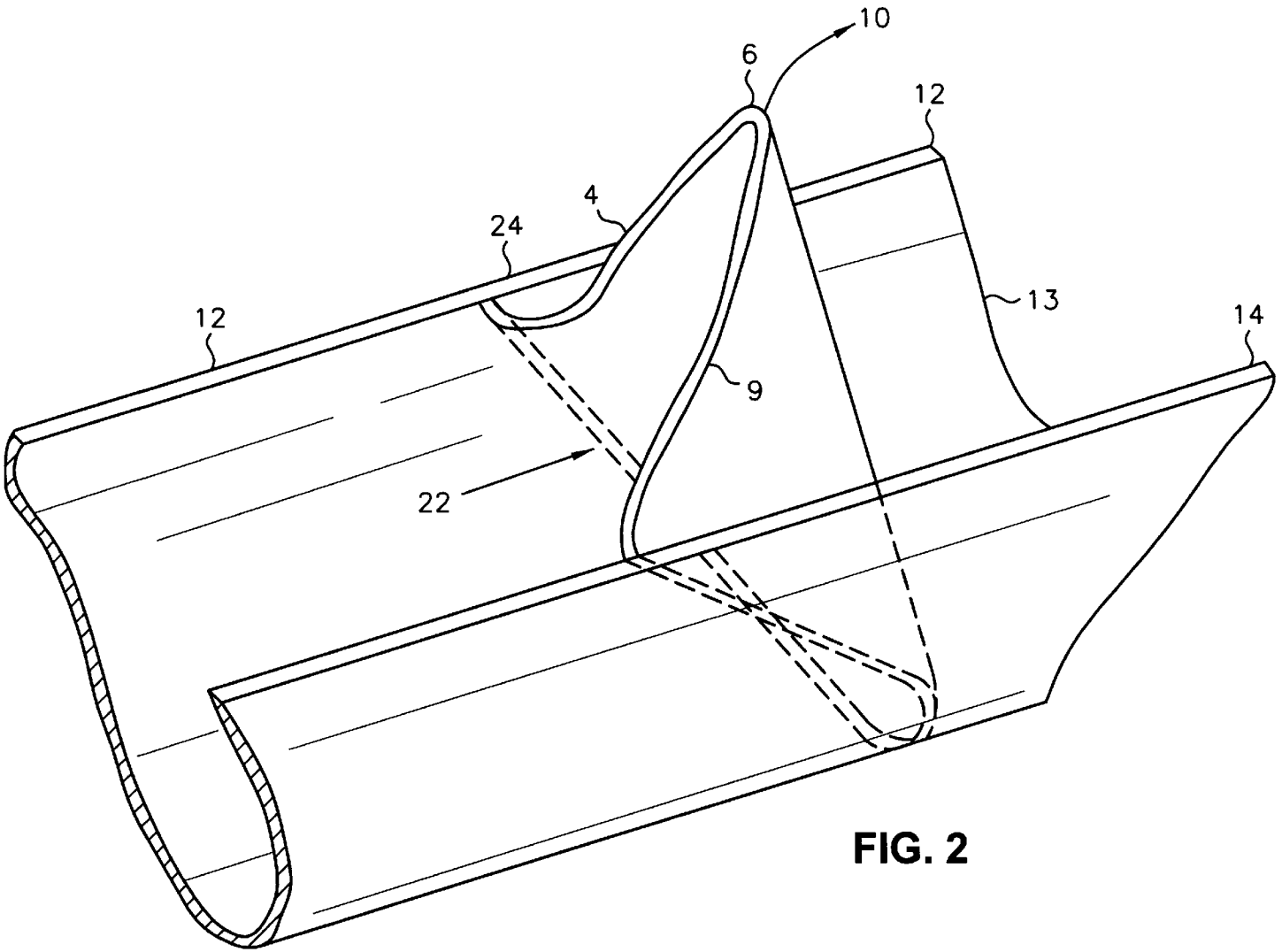
FIG. 2 is a developmental view of the end section encasement of the present invention illustrating a folding step used in the manufacture of the invention.
Figure 3:
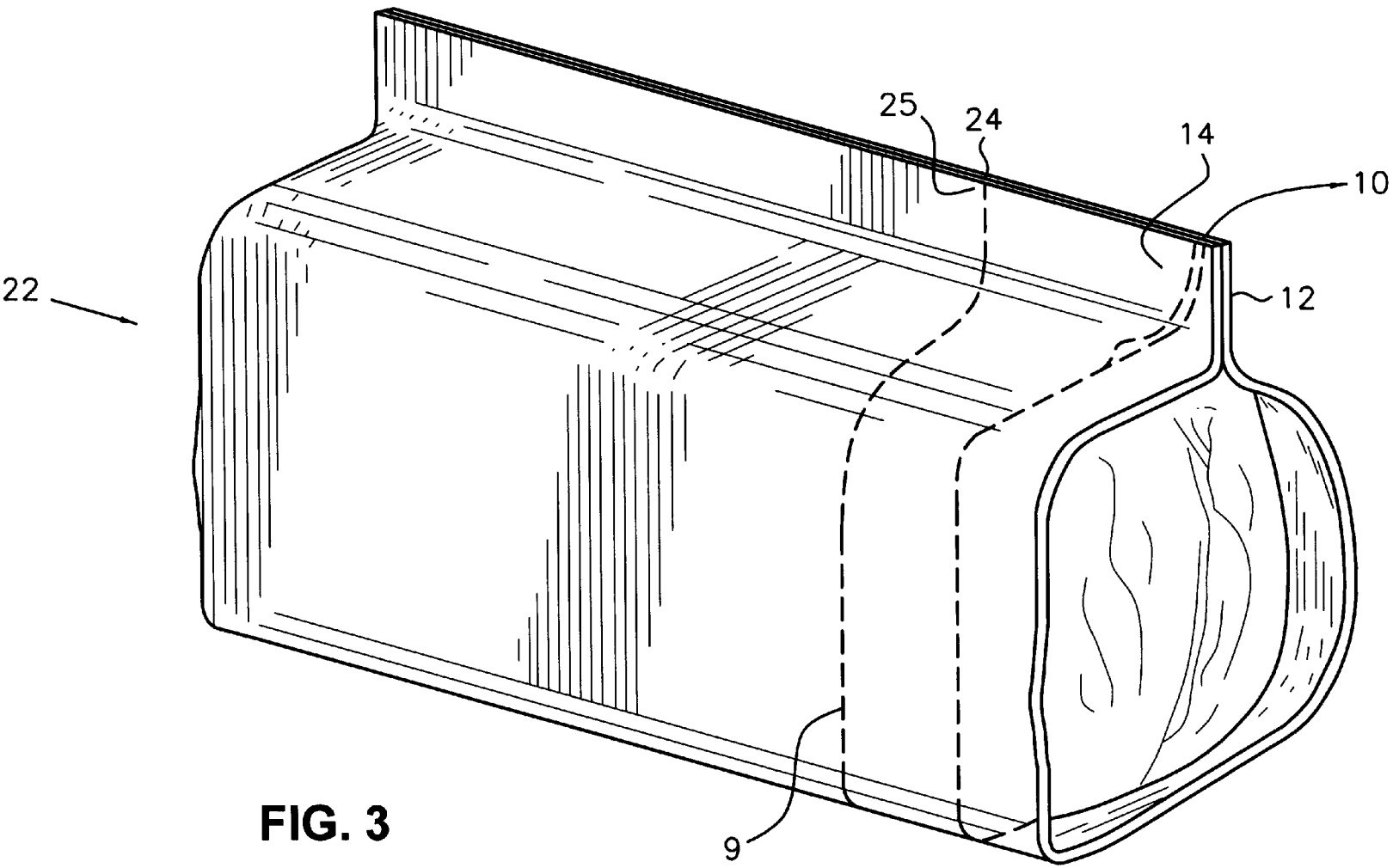
FIG. 3 is a view of the cell encasement in its finished form.

The present invention will now be described with reference to the various drawings wherein like numerals refer to like parts. Turning now to FIG. 1, it can be seen in beginning stage that the airtight cell described in the present invention is formed using a main sheet of PVC or polyester, nonporous material, which is attached to other accessory pieces of like material in a fashion to allow an end product which is an airtight cell encasing various electrical components, switches or other devices as described earlier. Main sheet 2 is laid out in a flat, generally rectangular shape about the length as may be desired depending on how long the final dimensions of the cell to be formed should be. Length of main sheet 2 maybe as small as several inches, to as long as may be required to produce an airtight cell for use as edge stripping material for a garage door, elevator door edge or other like application. In such case, the length of the airtight cell could easily be 10 to 20 feet in a typical application. FIG. 1 shows one edge of the airtight cell to illustrate the attachment technique and forming method used starting at one end. To main sheet 2, top sheet 4 is attached along seam 8, such as provide attached material which is shaped in a modified trapezoid. A modified trapezoid of top sheet 4 is welded using RF heating techniques to attach along the weld 8, as illustrated in FIG. 1. Seam 8 extends along the edge of top sheet 4 which is closest to edge 13 of main sheet 2. This can be seen in the figures, seam 8 attached to top sheet 4 from the first lengthwise edge 12, the second edgewise 14 such as to create a pocket in the direction of the center of main sheet 2. Free edge 9 of top sheet 4, provides a pocket-like structure when the top sheet in point 6 is lifted away from main sheet 2.

In order that the pocket be formed and welded in one piece, it can be appreciated by review of the various figures that top sheet edge point 6, if folded up and away from main sheet 2 in the direction illustrated by numeral 10, such an operation will pull edges 12 and 14 together, closing the center area and meeting along the seam being formed by edge 12, 14 and top sheet 4. After this one-step operation, the seam along edge 12 and edge 14 can be sealed using RF heating techniques or other sealing means, whereby an airtight cell is formed between top sheet 4, representing one edge of the cell, and main sheet 2. A one-step sealing process is possible because when edges 12 and 14 are brought together, they sandwich the free edges 9 of top sheet 4. A one-step welding process, then applied along seam formed by edge 12 and edge 14, will provide a seal which is both watertight and airtight and thus, provides the means produce an airtight cell as required.

The inherent advantage over the prior art is found in the fact that the pre-formed shape of top sheet 4 provides a crispier and more solidly formed edge because of the trapezoidal shape of top sheet 4, as compared to the prior art utilizing flat sheets of material attached to the main sheet of the cell forming material. The advantages that there is less wasted material, and there is less deformation in free edges 9 of top sheet 4. In the finally drawn and closed position, there is less wrinkling of the body of sheet 4 as compared with conventional techniques which use a rectangular top sheet 4 which requires an additional step in the folding process as disclosed by the prior art.

Thus it is apparent that it has been provided, in accordance with the invention, a means and method for manufacture of an airtight cell to enclose switching apparatus which fully satisfies the objectives, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims.

What is claimed is:

1. A method for forming a sealed end from two pieces of material comprised of:

a first sheet of substantially flat material, substantially rectangular in shape, and a second sheet of substantially flat material, comprised of five sides, wherein said sealed end is formed by attaching three edges of said second sheet to a substantially flat side of said first sheet; then folding said first sheet upon itself, across a direction which causes the first sheet to be folded about its longitudinal axis, wherein said second sheet is then drawn vertically such as to allow a side of said second sheet furthest from a side of said first sheet to which said second sheet is attached to protrude above the edges of said first sheet as the first sheet is folded about its longitudinal axis, wherein then the edges of said first sheet parallel to the said longitudinal axis of said first sheet are compressed against each other such as to hold two unattached edges of said second sheet which are drawn vertically, wherein the edges of said first sheet are welded, further welding there between the vertically drawn edges of said second sheet.

2. A method for making an airtight cell from three separate sheets of material, whereby: a first sheet, substantially rectangular in shape, forming the main wall of said airtight cell; and a second sheet of material, comprised of five sides in a flat shape, comprising one end of said cell; and a third sheet of material, comprised of five sides in a flat shape, comprising a second end of said cell; are combined to comprise a substantially elongated shape, formed by a combination of welding of said second sheet of material to said first sheet and welding said third sheet of material to said first sheet, wherein said airtight cell is formed by attaching three edges of said second sheet and of said third sheet to opposite ends of a flat side of said first sheet;

whereby further said second sheet is attached to the first sheet, substantially toward a first end of the first sheet; said third sheet is attached substantially toward a second end of said first sheet which is opposite the first end of said first sheet, wherein unattached edges of said second sheet and of said third sheet are then drawn vertically such as to allow the unattached sides of said second sheet and said third sheet to protrude above the edges of said first sheet as it is folded about said longitudinal axis, then folding said first sheet upon itself, across a direction which causes the first sheet to be folded about its longitudinal axis, wherein then the edges of said first sheet are compressed against each other such as to hold the edges of said second and third sheets which are drawn vertically, wherein the edges of said first sheet are welded, further welding there between the vertically drawn edges of said second and third sheets.

* * * * *